US005358223A

United States Patent [19]

Bleijendaal et al.

[11] Patent Number: 5,358,223

[45] Date of Patent: Oct. 25, 1994

[54] HOT-BLAST MAIN FOR HOT-BLAST STOVE SYSTEM OF A BLAST FURNACE

[75] Inventors: Nicolaas G. J. Bleijendaal, Akersloot; Jacob Felthuis, Alkmaar; Ronald J. M. Stokman, Hillegom, all of Netherlands

[73] Assignee: Hoogovens Groep B.V., Ca Ijmuiden, Netherlands

[21] Appl. No.: 139,111

[22] Filed: Oct. 21, 1993

[30] Foreign Application Priority Data

Oct. 23, 1992 [NL] Netherlands ..... 9201838

[51] Int. Cl.[5] ..... C21B 7/16

[52] U.S. Cl. ..... 266/138; 266/186

[58] Field of Search ..... 266/138, 186, 139, 140, 266/141, 218, 270

[56] References Cited

U.S. PATENT DOCUMENTS 4,987,838 1/1991 Mailliet et al. ..... 266/186

FOREIGN PATENT DOCUMENTS 1313878 5/1987 U.S.S.R. ..... 266/141
3717497 12/1988 Fed. Rep. of Germany .
2193174 2/1974 France .
5947309 3/1984 Japan ..... 266/139
7506262 12/1975 Netherlands .
2172982 10/1986 United Kingdom .

*Primary Examiner*—Melvyn J. Andrews
*Attorney, Agent, or Firm*—Stevens, Davis, Miller & Mosher

[57] ABSTRACT

A hot-blast main for a hot-blast stove system of a blast furnace has a refractory structure comprising a plurality of courses of refractory bricks. At least a first one of the courses has at least one part thereof comprised of a plurality of expansion-joint forming bricks whose dimensions and arrangement are such that, in the cold condition of the hot blast main, there are provided radial expansion joints between the expansion-joint forming bricks and at least one adjacent part of the hot-blast main. At least some of the expansion-joint forming bricks of the first course are placed radially staggered relative to at least one adjacent such brick in each case, so that the expansion joints are provided at both the radially inner side and the radially outer side of said first course. This construction accommodates differential thermal expansions and provides good stability of the structure.

6 Claims, 2 Drawing Sheets

4
2
1
4A
7A
10
7B
3
9
5A
5B
6A
6B
8

HOT-BLAST MAIN FOR HOT-BLAST STOVE SYSTEM OF A BLAST FURNACE

BACKGROUND OF THE INVENTION

1. Field of the Invention

The invention relates to a hot-blast main for a hot-blast stove system of a blast furnace. The main comprises a brickwork structure of a plurality of courses of refractory bricks forming a conduit for hot gas. Such a hot-blast main is generally known from the practice of blast-furnace plants.

2. Description of the Prior Art

A hot-blast main with a plurality of brick courses is described for example in the French patent specification no. 2193174. The courses of refractory bricks are in this construction on the outward side of an insulating inner lining, and directly adjoin the steel outer shell of the hot-blast main. The courses are composed of, for example, porous alumina bricks of a quality which is chosen in dependence on the temperature level at the position of the insulating lining during operation of the hot-blast stove system.

In the applications of such a hot-blast main at elevated temperatures the refractory inner lining mentioned is usually made of silica. Consequently this has different thermal expansions from the outer courses of refractory bricks. The overall expansion pattern is complex, because the coefficients of thermal expansion of these materials vary with temperature. In practice the construction is provided with an expansion possibility to compensate for these thermal expansion differences. However, the technical problem then to be solved is to design the main in such a way that it is stable both in cold condition, during heating up and in operating condition, since in certain applications the innermost refractory lining comes into contact with hot blast of temperature as high as 1500° C.

SUMMARY OF THE INVENTION

The problem to which this invention aims to provide a solution, is to provide a hot-blast main which has sufficient stability under all circumstances.

The hot-blast main in accordance with the invention has a refractory structure comprising a plurality of courses of refractory bricks. At least a first one of the courses has at least one part thereof comprised of a plurality of expansion-joint forming bricks whose dimensions and arrangement are such that, in the cold condition of the hot blast main, there are provided radial expansion joints between said expansion-joint forming bricks and at least one adjacent part of said hot-blast main. At least some of the plurality of expansion-joint forming bricks of the first course are placed radially staggered relative to at least one adjacent such brick in each case, so that the expansion joints are provided at both the radially inner side and the radially outer side of the first course. Surprisingly this unusual design has proved to offer sufficient static support to the refractory structure of the hot-blast main.

The hot-blast main in accordance with the invention finds in particular advantageous application as a connecting conduit between the domes of hot-blast stoves of the type with external combustion chamber.

The radial staggering of the brisk providing expansion joints has the effect of providing an interrupted circumferentially extending expansion joint. These expansion joints are preferably closed in the operating condition. For further enhancement of the static balance of forces in the hot-blast main in the cold condition, the joints may be provided with a compressible material selected from ceramic felt and ceramic wool.

The invention is especially applicable when a radially innermost layer of the refractory structure is formed of material of different coefficient of thermal expansion from that of the bricks of said first course which is located outwardly of the innermost layer, the expansion joints provided by the expansion-joint forming bricks being adapted to accommodate differential thermal expansion of parts of the refractory structure while maintaining structural stability thereof.

A preferred aspect of the invention is that the part of said first course comprises of the expansion-joint forming bricks is a portion at which the circumferential direction of the course is generally vertical, e.g. at the lateral wall parts of a horizontal hot-blast main.

In a preferred embodiment of the invention, the expansion-joint forming bricks are arranged in pairs, with the two bricks of each pair having their respective radially inner faces flush with each other and their respective radially outer faces flush with each other, while each pair is radially staggered relative to at least one adjacent such pair.

The advantages of the invention fully show in a construction in which the main has two parts of said first course, both comprised of said expansion-joint forming bricks, which two parts are respectively at diametrally opposed portions of said main at which the circumferential direction of the first course is generally vertical, and the first course has a further plurality of refractory bricks which form an arch supported by said two parts comprised of the expansion-joint forming bricks, the arch bounding a continuous expansion joint between said first course and an adjacent course of the refractory structure.

BRIEF INTRODUCTION OF THE DRAWINGS

The invention will now be illustrated by way of non-limitative example with reference to the drawings, which show one embodiment. In the drawings:

FIG. 1 is a cross section of a hot-blast main in accordance with the invention; and FIG. 2 is a detailed representation of the portion A of FIG. 1 of the hot-blast main in accordance with the invention.

DESCRIPTION OF THE PREFERRED EMBODIMENT

The general arrangements and construction of a hot-blast main, which finds application in a hot-blast stove system of a blast furnace and cooperates with the hot-blast stoves of such a system, are known to experts in this field, and further discussion thereof can be omitted.

Figure 1:
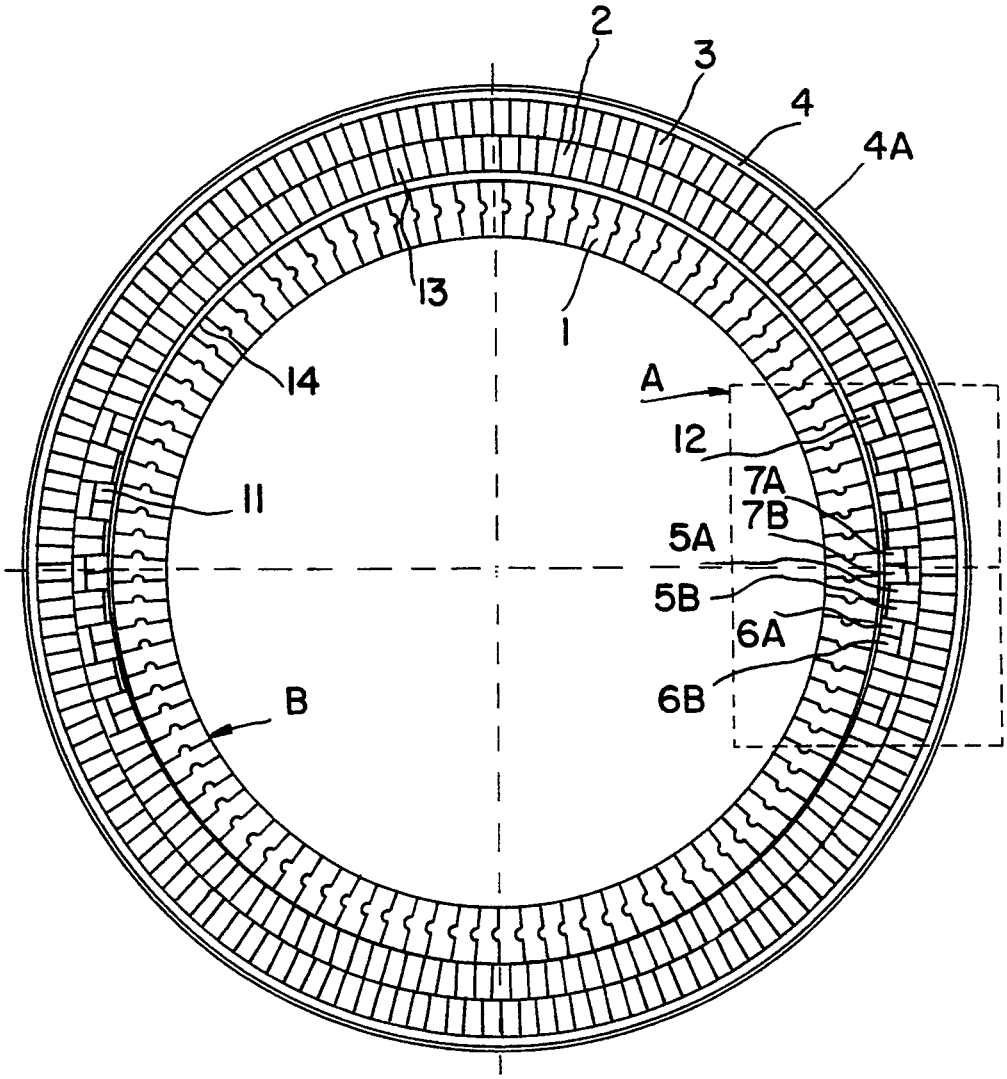

FIG. 1 shows a cross section of a horizontally extending hot-blast main in accordance with the invention which comprises an innermost layer in the form of a course of silica bricks 1 and outwardly adjacent the course 1 two courses 2 and 3 of refractory insulating bricks made of a conventional porous alumina, which in this embodiment are surrounded by a refractory concrete lining 4 inside the tubular steel shell 4A.

In order to prevent .the hot-blast main from having a relatively short service life due to differences in expansion of the course of silica bricks 1 relative to that of the course 2 of refractory insulating bricks in particular, the course 2 of refractory insulating bricks is partly provided with refractory expansion-joint forming bricks 5A,5B,6A,6B,7A,7B of adapted dimensions. These bricks of adapted dimensions are located in the portion of the hot-blast main extending generally vertically in its circumferential direction which is represented in detail A shown in FIG. 2. Further bricks of the type of these adapted dimensions are also provided in the portion B of the hot-blast main diametrally opposite portion A.

These bricks of adapted dimensioning are incorporated in the brickwork as pairs 5A,5B; 6A,6B and 7A,7B. In each pair, the two bricks have flush radially inner faces and flush radially outer faces. However the adjacent pairs are radially staggered, relative to each other. As a consequence of this staggered position, the hot-blast main has interrupted or disconnected expansion joints 8,9 and 10 which according to circumstances may be provided with a filling of oil paper, ceramic felt, ceramic wool or graphite foil. By making the filling of ceramic felt or ceramic wool, the static balance of the hot-blast main in cold condition is particularly enhanced.

Figure 2:
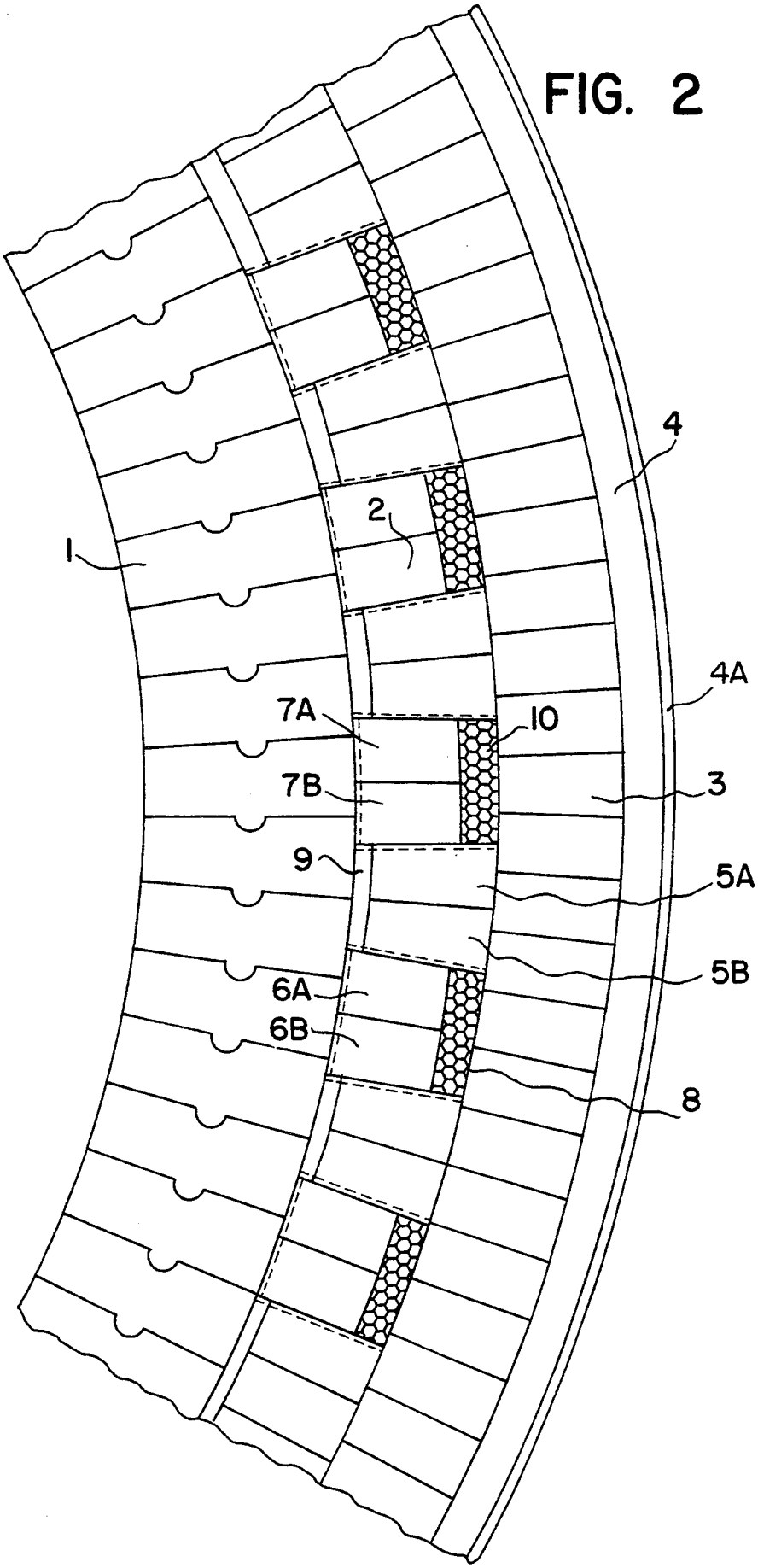

It can be seen in FIG. 2 that, whereas the mutually abutting faces of the two bricks 5A,5B; 6A,6B; 7A,7B of each pair are radial, the abutting faces between the respective adjacent pairs are non-radial. The pair 5A,5B is thus wedge-shaped.

In the course 2, an arch 13 of uniform refractory bricks which bound a continuous expansion joint 14 is supported on the upper bricks 11,12 of the type of adapted dimensions.

The hot-blast main constructed in this way in accordance with the invention is stable both in cold condition, during the heating-up stage and in operating condition. The joints 8,9 and 10 are open at cold condition but closed in operating condition due to expansion of the bricks bounding the joint, as a result of which the structure of the construction of the hot-blast main is stable and effective in that condition.

While the invention has been illustrated by the embodiment described, it is not limited thereto, and its scope extends to equivalents and other constructions within the inventive concept.

What is claimed is

1. A hot-blast main for a hot-blast stove system of a blast furnace, said main having a refractory structure comprising a plurality of courses of refractory bricks, at least a first one of said courses having at least one part thereof comprised of a plurality of expansion-joint forming bricks whose dimensions and arrangement are such that, in the cold condition of the hot blast main, there are provided radial expansion joints between said expansion-joint forming bricks and at least one adjacent part of said hot-blast main, at least some of said plurality of expansion-joint forming bricks of said first course being placed radially staggered relative to at least one adjacent such brick in each case, so that said expansion joints are provided at both the radially inner side and the radially outer side of said first course.

2. A hot-blast main according to claim 1 wherein a radially innermost layer of said refractory structure is formed of material of different coefficient of thermal expansion from that of the bricks of said first course which is located outwardly of said innermost layer, said expansion joints provided by said expansion-joint forming bricks being adapted to accommodate differential thermal expansion of parts of said refractory structure while maintaining structural stability thereof.

3. A hot-blast main according to claim 1 wherein said expansion joints provided by said expansion-joint forming bricks contain compressible material selected from ceramic felt and ceramic wool.

4. A hot-blast main according to claim 1 wherein said part of said first course comprised of said expansion-joint forming bricks is a portion at which the circumferential direction of said course is generally vertical.

5. A hot-blast main according to claim 4 having two said parts of said first course, both comprised of said expansion-joint forming bricks, which two parts are respectively diametrally opposed portions of said main at which the circumferential direction of the first course is generally vertical, said first course having a further plurality of refractory bricks which form an arch supported by said two parts comprised of said expansion-joint forming bricks, said arch bounding a continuous expansion joint between said first course and an adjacent course of said brickwork structure.

6. A hot-blast main according to claim 1 wherein said expansion-joint forming bricks are arranged in pairs, with the two bricks of each said pair having their respective radially inner faces flush with each other and their respective radially outer faces flush with each other, while each said pair is radially staggered relative to at least one adjacent said pair.

* * * * *